US005294269A

United States Patent [19]

Lee et al.

[11] Patent Number: 5,294,269

[45] Date of Patent: Mar. 15, 1994

[54] REPEATED SINTERING OF TUNGSTEN BASED HEAVY ALLOYS FOR IMPROVED IMPACT TOUGHNESS

[75] Inventors: Young M. Lee; Kyung J. Park, both of Kyungsanbuk-do; Kil S. Churn, Taejon-si; Woon H. Baek, Taejon-si; Heung S. Song, Taejon-si; Joon W. Noh, Taejon-si; Moon L. Hong, Taejon-si; Seong Lee, Taejon-si; Eun P. Kim, Taejon-si, all of Rep. of Korea

[73] Assignees: Poongsan Corporation, Inchon; Agency for Defense Development, Taejon-si, both of Rep. of Korea

[21] Appl. No.: 51,425

[22] Filed: Apr. 23, 1993

[30] Foreign Application Priority Data

Aug. 6, 1992 [KR] Rep. of Korea ..... 14130

[51] Int. Cl.[5] ..... C22C 27/00

[52] U.S. Cl. ..... 148/514; 75/248; 148/673; 420/430

[58] Field of Search ..... 148/514, 673; 420/430; 75/248

[56] References Cited

U.S. PATENT DOCUMENTS

| | | | |
|---|---|---|---|
| 3,300,285 | 1/1967 | Pugh et al. | 420/430 |
| 4,784,690 | 11/1988 | Mullendore | 420/430 |
| 4,801,330 | 1/1989 | Bose et al. | 420/430 |
| 4,851,042 | 7/1989 | Bose et al. | 420/430 |
| 5,064,462 | 11/1991 | Mullendore et al. | 420/430 |

OTHER PUBLICATIONS

Churn et al. Powder Metallurgy 1979, Nr. 4, pp. 175–178.

*Primary Examiner*—Upendra Roy

*Attorney, Agent, or Firm*—Armstrong, Westerman, Hattori, McLeland & Naughton

[57] ABSTRACT

A method for heat-treatment of tungsten based alloys, capable of improving impact toughness while keeping tensile strength and elongation. The method comprises maintaining a sintered tungsten based alloy consisting of 86 to 99 weight % tungsten and the balance at least one selected from a group consisting of nickel, iron, copper, cobalt and molybdenum, at a temperature ranged from 950° to 1,350° C. for a maintenance time of one minute to 24 hours, quenching the sintered alloy in water or in oil, and repeating the maintaining and quenching steps.

8 Claims, 4 Drawing Sheets

REPEATED SINTERING OF TUNGSTEN BASED HEAVY ALLOYS FOR IMPROVED IMPACT TOUGHNESS

BACKGROUND OF THE INVENTION

1. Field of The Invention

The present invention relates to tungsten based alloys, and more particularly to a method for heat-treatment of tungsten based alloys, capable of improving impact toughness, namely, impact energy while keeping tensile strength and elongation.

2. Description of the Prior Art

Tungsten based heavy alloys contain tungsten of at least 90 weight %. They also contain nickel, iron and/or copper.

Referring to FIG. 1, there is illustrated a typical microstructure of the tungsten based alloys. As shown in FIG. 1, the microstructure comprises spherical tungsten grains (BCC) and a matrix phase (FCC) which consists of nickel, iron and tungsten or of nickel, copper and tungsten. The tungsten based alloys are usually manufactured by a liquid phase sintering process which is a kind of powder metallurgy. This liquid phase sintering process is illustrated in FIG. 2.

Tungsten based heavy alloys exhibit a high density of 16 to 19.1 g/cm$^3$, a superior tensile strength of 700 to 950 MPa, a high elongation of 5 to 25% and a superior formability or machinability, depending on their alloy compositions such as tungsten, nickel, iron and/or copper contents. Thus, the tungsten based heavy alloys are widely used in fields requiring both a small volume and a heavy weight.

For example, the tungsten based heavy alloys are widely used for rotors, balance weights for aircrafts and shield materials against radioactive rays in commercial industry fields and core materials for kinetic energy penetrators in military industry fields. Recently, the speed of rotors and aircrafts is on an increasing trend. Such a trend involves a requirement for increasing a stability of structural elements against fracture. Where the tungsten heavy alloys are used as the materials for penetrators, it is believed that the penetration depth increases with increasing impact toughness.

As mentioned above, the tungsten heavy alloy is a kind of composite material comprising hard tungsten grains and a ductile matrix phase and having two kinds of characteristic interfaces, namely, tungsten-matrix and tungsten-tungsten interfaces. It is known that the bonding strength of the tungsten-matrix interface is higher than that of the tungsten-tungsten interface. Accordingly, the impact toughness of tungsten heavy alloys is considerably dependant on the relative fraction of tungsten-tungsten and tungsten-matrix interfaces.

On the other hand, it is also known that the bonding strength of the tungsten-matrix interfaces is greatly decreased due to a segregation of impurities. For maximizing the impact toughness of tungsten heavy alloys, accordingly, it is required to minimize both the relative fraction of the tungsten-tungsten interfaces and the segregation of impurities in the tungsten-matrix interfaces.

Now, the variation in bonding strength caused by the segregation of impurities in the tungsten-matrix interfaces will be described.

The decrease of bonding strength at the tungsten-matrix interfaces is caused by the fact that impurities such as phosphorous, sulphur and carbon contained in the raw materials and hydrogen are segregated in the tungsten-matrix interfaces, due to the difference in solubility. Thus, for enhancing the impact toughness of tungsten heavy alloys, it is required to remove the hydrogen and to prevent the segregation of impurities at tungsten-matrix interfaces by using a heat-treatment after sintering.

Referring to FIG. 3 there is illustrated a conventional heat-treatment proposes for removing the hydrogen and preventing the segregation of impurities. This heat-treatment comprises the steps of maintaining a sintered tungsten heavy alloy at a temperature of 1,000° to 1,200° C. in an atmosphere of an inert gas such as nitrogen or argon or in a vacuum and then water quenching.

The purpose of the maintaining at such a high temperature is to remove the remaining hydrogen and to diffuse out the segregation of impurities. On the other hand, the water quenching makes it possible to prevent the re-segregation of impurities. Hence, the heat-treatment greatly contributes to an increase in impact toughness of the tungsten heavy alloy.

Although the impact toughness is increased by solving the problems of the brittleness caused by the hydrogen and the segregation of impurities at tungsten-matrix interfaces, the conventional heat-treatment method has a limitation on the increase in impact toughness, in that the relative fraction of tungsten-tungsten interfaces which are the most brittle interfaces of tungsten heavy alloys can not be controlled.

Accordingly, it is required to develop a method for changing brittle tungsten-tungsten interfaces to strong tungsten-matrix interfaces so as to obtain an improvement in impact toughness.

SUMMARY OF THE INVENTION

Therefore, an object of the invention is to provide a method for heat-treatment of tungsten heavy alloys, capable of improving impact toughness.

For accomplishing this object, the present invention provides a new method for heat-treatment of a sintered tungsten based alloy consisting of 86 to 99 weight % tungsten and the balance at least one selected from a group consisting of nickel, iron, copper, cobalt and molybdenum, comprising the steps of: maintaining the sintered alloy at temperatures ranged from 950° to 1,350° C. for one minute to 24 hours; quenching the sintered alloy in water or in oil; and repeating the maintaining and quenching steps.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENTS

Taking into consideration that a thermal expansion coefficient of tungsten grain ($4.6\times10^{-6}$/° C.) is higher than that of a matrix phase ($2.0\times10^{-6}$° C.), by about 4.5 times, the present invention provides a heat-treatment comprising repeated heating and quenching, so as to provide a high dislocation density at a matrix contacting tungsten grains and thereby change brittle tungsten-tungsten interfaces to strong tungsten-matrix interfaces.

The present invention provides a method for heat-treatment of a tungsten heavy alloy comprising the steps of maintaining at temperatures ranged from 950° to 1,350° C. for one minute to 24 hours, quenching in water or oil, and repeating the maintaining and quenching steps.

Figure 4:
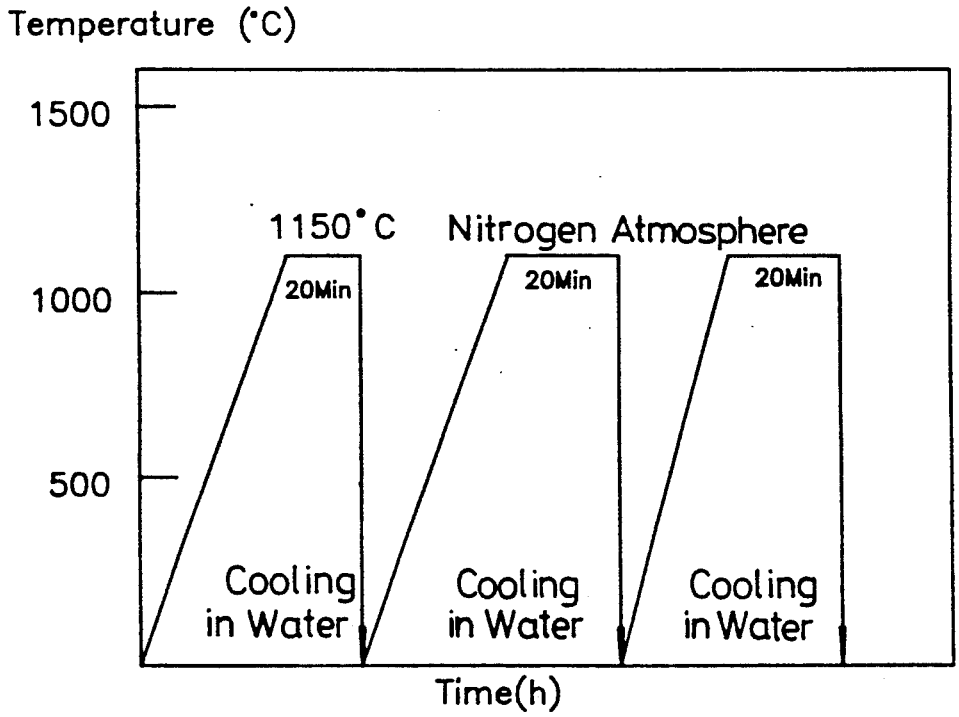
FIG. 4 is a graph illustrating a method for heat-treatment of tungsten heavy alloys in accordance with the present invention.

Referring to FIG. 4, there is illustrated a graph explaining the heat-treatment according to the present invention. As shown in FIG. 4, a sintered tungsten heavy alloy consisting of 86 to 99 weight % W, 0.5 to 9 weight % Ni and 0.5 to 5 weight % Fe is maintained at a temperature range of 950° to 1,350° C. for one minute to 24 hours. Thereafter, the tungsten heavy alloy is quenched in water or in oil. The above-mentioned heat-treatments are continuously repeated. The repeating cycles are 2 to 60.

Figure 5:
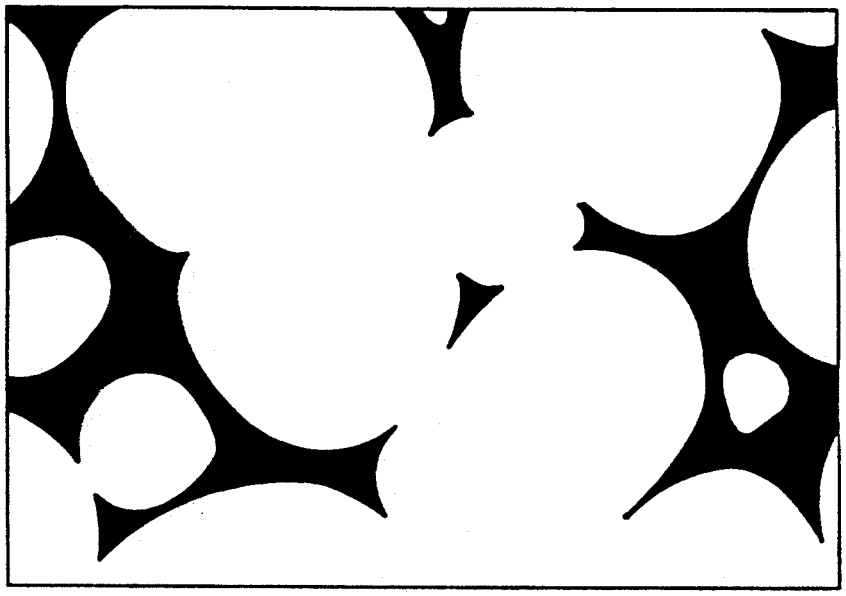
Fig. 5 PRIOR ART
FIG. 5 is a scanning electron microscopic (SEM) photograph of a tungsten heavy alloy manufactured by the conventional heat-treatment method.
Figure 6:
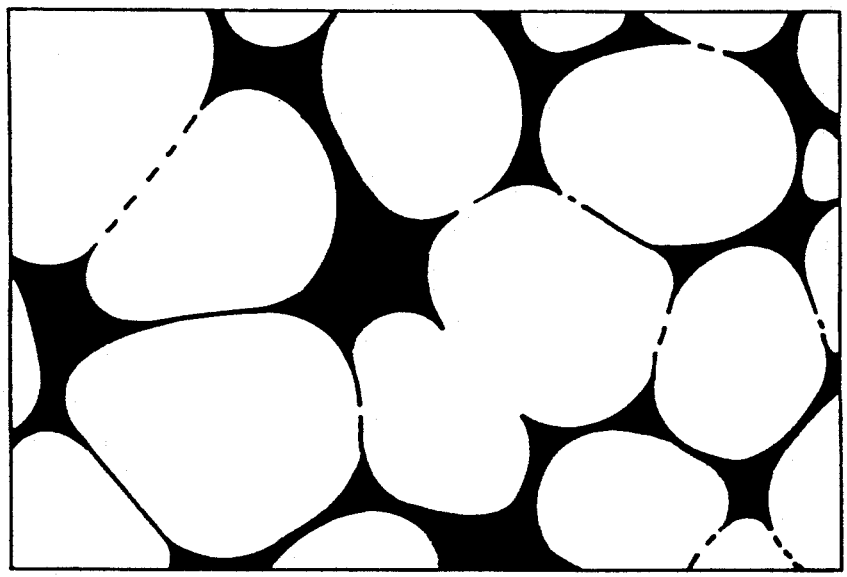
FIG. 6 is a SEM photograph of a tungsten heavy alloy manufactured by the heat-treatment method according to the present invention.
Figure 7:
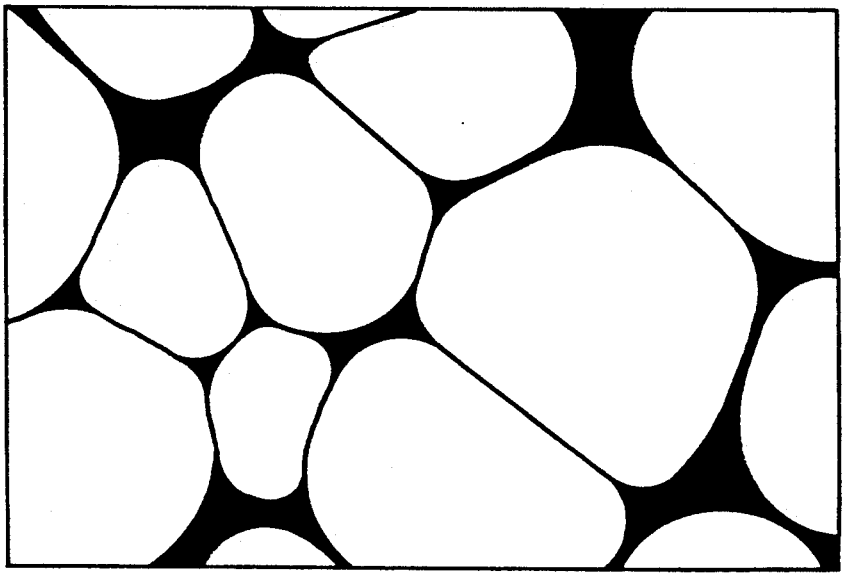
FIG. 7 is a SEM photograph of a tungsten heavy alloy manufactured by the heat-treatment method according to the present invention, illustrating the change of brittle tungsten-tungsten interfaces to strong tungsten-matrix interfaces.

The tungsten heavy alloy obtained according to the heat-treatment method of the present invention exhibits no brittleness caused by the hydrogen and by the segregation of impurities. In particular, as brittle tungsten-tungsten interfaces shown in FIGS. 5 to 7 is changed to strong tungsten-matrix interfaces, the impact toughness of tungsten heavy alloy is drastically increased by three times while maintaining tensile strength and elongation, as compared with the conventional heat-treatment methods. The impact toughness is increased in proportion to the repeating cycles of heat-treatment.

Where this heat treatment method is applied to other composite materials, it is also possible to expect an increase in impact toughness. For example, such an increase in impact toughness may be expected in cases of W-Ni-Cu, W-Cu, Mo-Ni and W-Co-Ni-Fe based alloys. That is, the present invention is not limited to the W-Ni-Fe based alloys.

The present invention will be understood more readily with reference to the following examples; however, these examples are intended to illustrate the invention and are not to be construed to limit the scope of the present invention.

EXAMPLE 1

Figure 1:
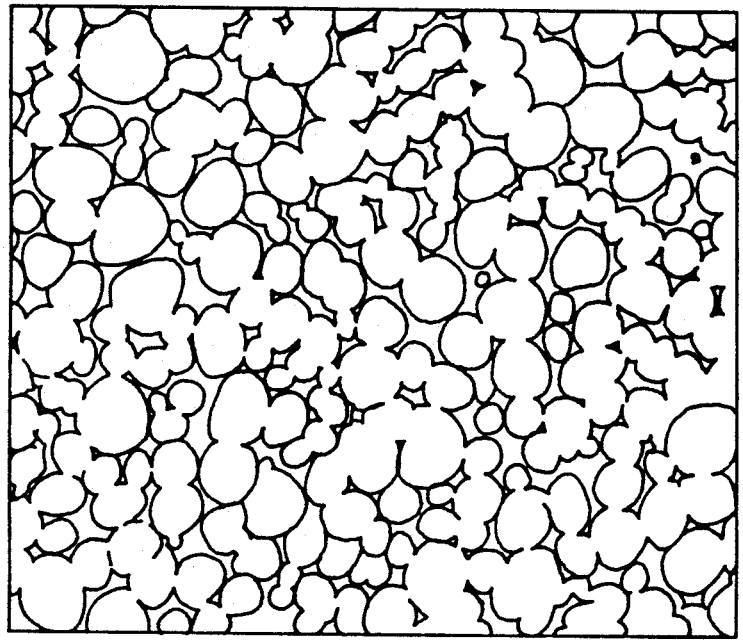
FIG. 1 is an optical microscopic photograph of a tungsten heavy alloy.
Figure 2:
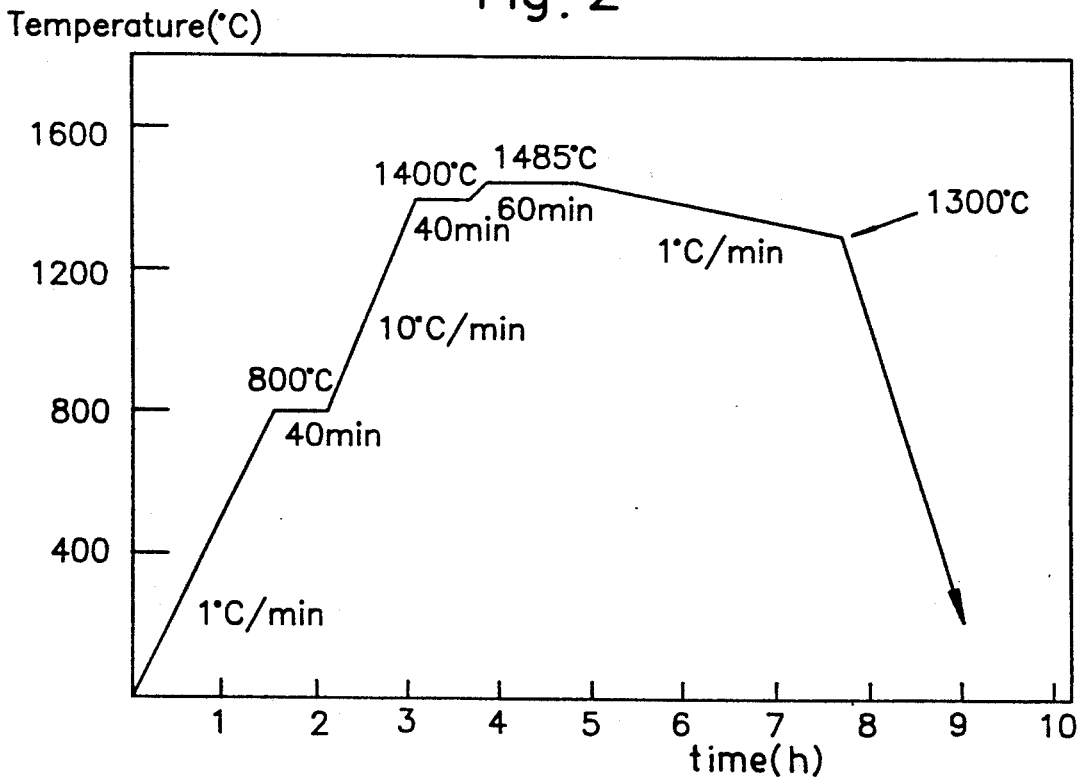
FIG. 2 is a graph illustrating a liquid phase sintering process.
Figure 3:
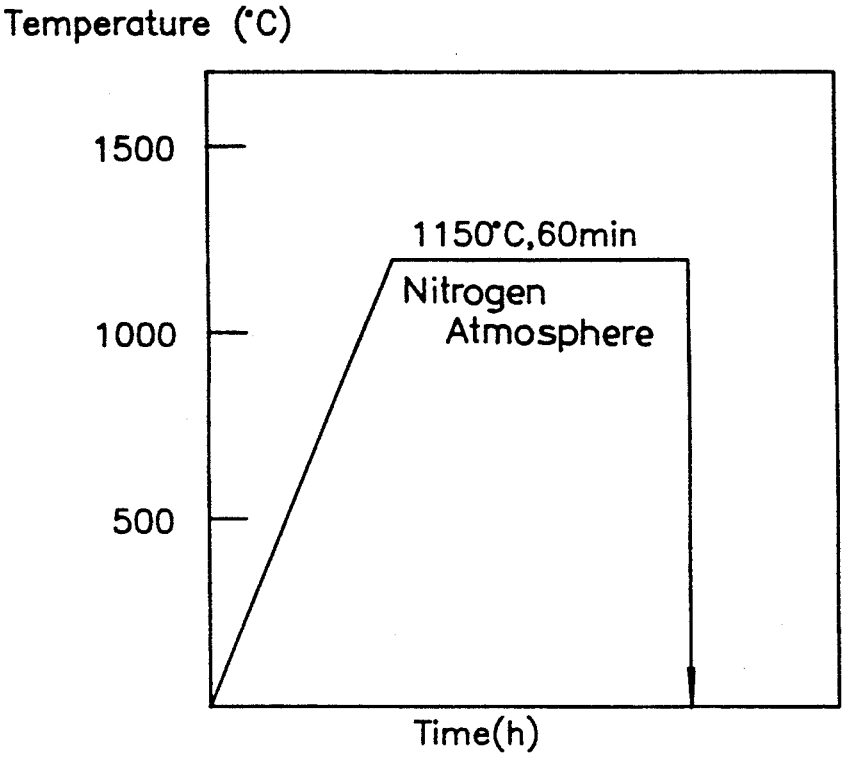
Fig. 3 PRIOR ART
FIG. 3 is a graph illustrating a conventional method for heat-treatment of tungsten heavy alloys.

A powder composition consisting of 93 weight % W, 5.6 weight % Ni and 1.4 weight % Fe was mixed by tubular mixer for 8 hours. The mixed powder was compacted under a stress of 100 MPa. Thereafter, the compact was sintered under hydrogen atmosphere according to thermal history shown in FIG. 2, so as to obtain impact test specimens with a size of 10 mm ×10 mm ×40 mm and tensile test specimens of ASTM E-8.

One of the sintered specimens was then maintained in a nitrogen atmosphere at a temperature of 1,150° C. Then, the specimen was quenched in water, to obtain Specimen 1. For other specimens, heat-treatments were carried with different repeating cycles, under the same atmosphere and temperatures as Specimen 1. In the present invention, the heat-treatment periods and repeating cycles are indicated in Table 1. Energy accumulated in specimens by virtue of the heat expansion coefficient difference between the tungsten grains and the matrix during the heating quenching procedures was used for the change of tungsten-tungsten interfaces to tungsten-matrix interfaces.

FIGS. 5 to 7 are photographs showing microstructures of Specimens 1, 4 and 6. Comparing the photographs with one another, it can be found that as the repeating cycles of heat-treatment increased, the brittle tungsten-tungsten interfaces were gradually changed to strong tungsten-matrix interfaces.

For specimens obtained by the heat-treatment method according to the present invention and the prior art, tensile strength, elongation, and Charpy impact energy were measured. The results are summarized at Table 1.

The tensile tests were carried out at a cross head speed of 2 mm per minute by using an Instron (Model Number 4505) with load cell capacity of 10 tons. The Charpy impact tests were carried out by using unnotched specimens having a size of 7.5 mm ×7.5 mm ×35 mm.

The tensile strength and elongation were obtained by calculating an average value of five tensile test results for each condition. On the other hand, each impact value is an average value of ten impact test results.

TABLE 1

| | Heat Treatment Condition | | | Tensile | | |
|---|---|---|---|---|---|---|
| Specimen No. | Tem. (°C.) | Maintenance Time | Repeating Cycles | Strength (MPa) | Elongation (%) | Impact Energy (joule) |
| 1* | 1,150 | 1 hour | 1 | 941 | 24.7 | 65 |
| 2 | 1,150 | 30 minutes | 2 | 937 | 24.4 | 99 |
| 3 | 1,150 | 12 minutes | 5 | 921 | 25.7 | 117 |
| 4 | 1,150 | 6 minutes | 10 | 922 | 24.9 | 131 |
| 5 | 1,150 | 4 minutes | 15 | 938 | 24.1 | 150 |
| 6 | 1,150 | 3 minutes | 20 | 933 | 23.9 | 175 |
| 7 | 1,150 | 2 minutes | 30 | 928 | 24.5 | 183 |
| 8 | 1,150 | 1 minutes | 60 | 923 | 25.1 | 187 |

*conventional specimen

As apparent from Table 1, it can be found that the specimens obtained by the heat-treatment method according to the present invention exhibited a substantially linear increase in impact energy with increasing the number of heat-treatment repeating cycles, without variations of the tensile strength and the elongation, as compared with the specimen (Specimen 1) obtained by the conventional heat treatment method. In particular, it can be found that at 20 cycles heat-treated specimen, the impact energy was surprisingly increased by at least three times.

On the other hand, the specimens 7 and 8 subjected to heat-treatments of 30 and 60 cycles exhibited impact energy values substantially identical to that of the Specimen 6 subjected to heat-treatments of 20 cycles.

EXAMPLE 2

For evaluating the effect of the heat-treatment temperature on the mechanical properties (tensile strength, elongation and impact energy), specimens were prepared in the same manner as Example 1 and the same heat-treatments as those of Specimens 1 and 6 of Example 1 were used. However, this example used different heat treatment temperatures of 920° and 1,350° C. For obtained specimens, the tensile strength, the elongation and the impact toughness were tested in the same manner as Example 1. The test results are described in Table 2. Specimens 9 and 10 indicated in Table 2 were heat-treated one and 20 cycles at a temperature of 950° C., respectively. On the other hand, Specimens 11 and 12 were heat-treated one and 20 cycles at a temperature of 1,350° C., respectively.

TABLE 2

| Tem. | 950° C. | | 1,350° C. | |
|---|---|---|---|---|
| Specimen | 9 | 10 | 11 | 12 |
| Tensile Strength (MPa) | 947 | 938 | 921 | 932 |
| Elongation (%) | 21.5 | 22.7 | 21.7 | 20.8 |
| Impact Energy (joule) | 40 | 98 | 51 | 109 |

As apparent from Table 2, the impact energy of heat-treated specimens at 950° and 1,350° C. increases with increasing repeating cycles of heat-treatment, while the tensile strength and elongation remains unchanged, in similar to the cases carried out at 1,150° C.

EXAMPLE 3

For evaluating the effect of the repeated heat-treatments on the mechanical properties of tungsten heavy alloys with different alloy compositions, specimens with compositions of 90% W-5% Ni-5% Fe and 95% W-4.5% Ni-0.5% Fe were prepared and sintered in the same manner as Example 1. Thereafter, the specimens were heat-treated in the same manner as Specimens 1 and 6 of Example 1. For obtained specimens, the tensile strength, the elongation and the impact energy were tested in the same manner as Example 1. The test results are described in Table 3. Specimens 13 and 14 indicated in Table 3 had the composition of 90% W-5% Ni-5% Fe and were heat-treated one and 20 cycles, respectively. Specimens 15 and 16 had the composition of 95% W-4.5% Ni-0.5% Fe and were heat-treated one and 20 cycles, respectively.

TABLE 3

| Composition | 90W-5Ni-5Fe | | 95W-4.5Ni-0.5Fe | |
|---|---|---|---|---|
| Specimen | 13 | 14 | 15 | 16 |
| Tensile Strength (MPa) | 912 | 927 | 943 | 939 |
| Elongation (%) | 20.0 | 21.2 | 20.9 | 21.5 |
| Impact Energy (joule) | 52 | 112 | 26 | 55 |

As apparent from Table 3, it can be found that an impact energy was increased by the repeated heat-treatments according to the present invention, irrespective of the composition of tungsten heavy alloy.

EXAMPLE 4

For evaluating the effect of the maintenance time at the elevated temperature on the mechanical properties of 93W-5.6Ni-1.4Fe, specimens were prepared and heat-treated in the same manner as Specimen 3 of Example 1. However, this example used different maintenance times of one minute and 24 hours. The tensile strength, the elongation and the impact energy of each specimen were described in Table 4.

Specimens 17 and 18 indicated in Table 4 were maintained for one minute at 1,150° C. with repeating cycles of one and 5, respectively. On the other hand, Specimens 11 and 12 were maintained for 24 hours at 1,150° C. with repeating cycles of one and 5, respectively.

TABLE 4

| Maintenance Time | 1 minute | | 24 hours | |
|---|---|---|---|---|
| Specimen | 17 | 18 | 19 | 20 |
| Tensile Strength (MPa) | 935 | 927 | 941 | 929 |
| Elongation (%) | 25.1 | 24.7 | 24.9 | 25.2 |
| Impact Energy (joule) | 79 | 121 | 62 | 117 |

As apparent from Table 4, it can be found that the impact energy was increased by the repeated heat-treatments according to the present invention, irrespective of the maintenance time.

What is claimed is:

1. A method for heat-treatment of a sintered tungsten based alloy exhibiting a high impact toughness and consisting of 86 weight % to 99 weight % tungsten and the balance at least one selected from a group consisting of nickel, iron, copper, cobalt and molybdenum, comprising the steps of:

maintaining the sintered alloy at temperatures ranged from 950° to 1,350° C. for one minute to 24 hours;

quenching the sintered alloy in water or in oil; and repeating the maintaining and quenching steps.

2. A method in accordance with claim 1, wherein the maintaining step is carried out in an inert gas atmosphere.

3. A method in accordance with claim 1, wherein the repeating cycle is carried out from 2 to 60 times.

4. A method in accordance with claim 1, wherein the sintered alloy has a composition of W-Ni-Fe.

5. A method in accordance with claim 1 or claim 4, wherein the sintered alloy consists of 86 to 99 weight % W, 0.5 to 9 weight % Ni and 0.5 to 5 weight % Fe.

6. A method in accordance with claim 1, wherein the sintered alloy has a composition of W-Ni-Cu.

7. A method in accordance with claim 1, wherein the sintered alloy has a composition of W-Co-Ni-Fe.

8. A method in accordance with claim 1, wherein the sintered alloy has a composition of W-Cu.

* * * * *